US006237336B1

(12) United States Patent
Feucht et al.

(10) Patent No.: US 6,237,336 B1
(45) Date of Patent: May 29, 2001

(54) EXHAUST GAS RECIRCULATION SYSTEM IN AN INTERNAL COMBUSTION ENGINE AND METHOD OF USING SAME

(75) Inventors: Dennis D. Feucht, Morton; Keith E. Lawrence, Peoria, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/437,022

(22) Filed: Nov. 9, 1999

(51) Int. Cl.[7] ..... F02M 25/07
(52) U.S. Cl. ..... 60/605.2; 123/567.17
(58) Field of Search ..... 60/605.2; 123/568.17

(56) References Cited

U.S. PATENT DOCUMENTS

| | | | | |
|---|---|---|---|---|
| 1,476,942 | * | 12/1923 | Youngblood | 123/568.17 |
| 3,789,807 | | 2/1974 | Pinkerton . | |
| 3,948,233 | | 4/1976 | Helbling . | |
| 3,982,395 | | 9/1976 | Hasegawa et al. . | |
| 3,996,748 | * | 12/1976 | Melchior | 60/605.2 |
| 4,159,627 | | 7/1979 | Monch et al. . | |
| 4,250,711 | | 2/1981 | Zehnder . | |
| 4,291,760 | | 9/1981 | Argyle et al. . | |
| 4,640,256 | | 2/1987 | Conrad et al. . | |
| 5,207,714 | * | 5/1993 | Hayashi et al. | 123/568.17 |
| 5,425,239 | * | 6/1995 | Gobert | 60/605.2 |
| 5,533,487 | * | 7/1996 | Cailey | 60/605.2 |
| 5,617,726 | | 4/1997 | Sheridan et al. . | |
| 5,732,688 | | 3/1998 | Charlton et al. . | |
| 5,802,846 | | 9/1998 | Bailey . | |
| 5,957,116 | * | 9/1999 | Haegele et al. | 123/568.17 |

FOREIGN PATENT DOCUMENTS

| | | | | |
|---|---|---|---|---|
| 4422966 | * | 5/1995 | (DE) | 60/605.2 |

* cited by examiner

*Primary Examiner*—Michael Koczo
(74) *Attorney, Agent, or Firm*—Todd T. Taylor

(57) ABSTRACT

An internal combustion engine including at least one cylinder head defining a plurality of combustion cylinders. Each combustion cylinder has a displacement volume. An exhaust manifold is fluidly connected to each cylinder for transporting exhaust gas therefrom. An intake manifold provides combustion air to each cylinder. A turbocharger is driven by exhaust gas from the exhaust manifold and provides charged combustion air to the intake manifold. A mixing vessel has at least two inlets, at least one outlet and a mixing chamber. One of the inlets is fluidly connected with the exhaust manifold and an other of the inlets is fluidly connected with the turbocharger. The one inlet and the other inlet are connected with the mixing vessel in a parallel manner. The mixing chamber has a volume which is dependent upon a plurality of the displacement volumes.

11 Claims, 4 Drawing Sheets

EXHAUST GAS RECIRCULATION SYSTEM IN AN INTERNAL COMBUSTION ENGINE AND METHOD OF USING SAME

TECHNICAL FIELD

The present invention relates to internal combustion engines, and, more particularly, to exhaust gas recirculation systems in such engines.

BACKGROUND ART

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NoX). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

When utilizing EGR in a turbocharged diesel engine, the exhaust gas to be recirculated is preferably removed upstream of the exhaust gas driven turbine associated with the turbocharger. In many EGR applications, the exhaust gas is diverted directly from the exhaust manifold. Likewise, the recirculated exhaust gas is preferably reintroduced to the intake air stream downstream of the compressor and air-to-air after cooler (ATAAC). Reintroducing the exhaust gas downstream of the compressor and ATAAC is preferred due to the reliability and maintainability concerns that arise if the exhaust gas passes through the compressor and ATAAC. An example of such an EGR system is disclosed in U.S. Pat. No. 5,802,846 (Bailey), which is assigned to the assignee of the present invention.

With conventional EGR systems as described above, the charged and cooled combustion air which is transported from the ATAAC is at a relatively high pressure as a result of the charging from the turbocharger. Since the exhaust gas is also typically inducted into the combustion air flow downstream of the ATAAC, conventional EGR systems are configured to allow the lower pressure exhaust gas to mix with the higher pressure combustion air. Such EGR systems may include a venturi section which induces the flow of exhaust gas into the flow of combustion air passing therethrough. However, the exhaust gas may be drawn from only a subset of the combustion cylinders within the engine. For example, the exhaust gas may be drawn from only a single cylinder and thus is provided in a pulsed manner to the venturi section. Some of the combustion cylinders therefore receive an adequate mixture of combustion air and exhaust gas, while other cylinders receive very little or no exhaust gas in the combustion air mixture.

The present invention is directed to overcoming one or more of the problems as set forth above.

DISCLOSURE OF THE INVENTION

In one aspect of the invention, an internal combustion engine includes at least one cylinder head defining a plurality of combustion cylinders. Each combustion cylinder has a displacement volume. An exhaust manifold is fluidly connected to each cylinder for transporting exhaust gas therefrom. An intake manifold provides combustion air to each cylinder. A turbocharger is driven by exhaust gas from the exhaust manifold and provides charged combustion air to the intake manifold. A mixing vessel has at least two inlets, at least one outlet and a mixing chamber. One of the inlets is fluidly connected with the exhaust manifold and an other of the inlets is fluidly connected with the turbocharger. The one inlet and the other inlet are connected with the mixing vessel in a parallel manner. The mixing chamber has a volume which is dependent upon a plurality of the displacement volumes.

In another aspect of the invention, a method of recirculating exhaust gas in an internal combustion engine includes the steps of: providing at least one cylinder head defining a plurality of combustion cylinders, each combustion cylinder having a displacement volume; providing an exhaust manifold and an intake manifold, each fluidly connected to each cylinder; providing a mixing vessel having at least two inlets, at least one outlet and a mixing chamber, one of the inlets fluidly connected with the exhaust manifold and an other of the inlets fluidly connected with a turbocharger, the one inlet and the other inlet connected with the mixing vessel in a parallel manner; transporting exhaust gas from the exhaust manifold to the one inlet; transporting combustion air from the turbocharger to the other inlet; mixing the exhaust gas and the combustion air within the mixing chamber in a volume which is dependent upon a plurality of the displacement volumes; and transporting the mixed exhaust gas and combustion air to the intake manifold.

BEST MODE FOR CARRYING OUT THE INVENTION

Figure 1:
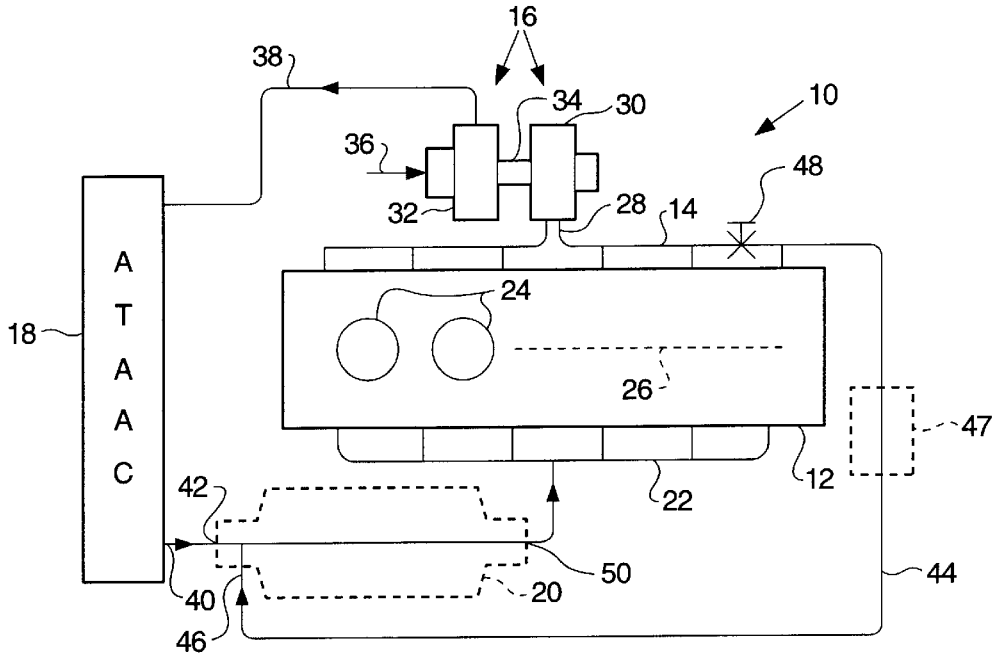
FIG. 1 is a schematic illustration of an embodiment of an internal combustion engine of the present invention.

Referring now to the drawings, and more particularly to FIG. 1, there is shown a schematic representation of an embodiment of an internal combustion engine 10 of the present invention. Internal combustion engine 10 generally includes a cylinder head 12, exhaust manifold 14, turbocharger 16, ATAAC 18, mixing vessel 20 and intake manifold 22.

Cylinder head 12 can be constructed as a single part cylinder head or a multi-part cylinder head. In the embodiment shown, cylinder head 12 is a single cylinder head which includes a plurality of combustion cylinders 24. The exact number of combustion cylinders 24 may be selected dependent upon a specific application, as indicated by dashed line 26. For example, cylinder head 12 may include six, ten or twelve combustion cylinders 24. Each combustion cylinder 24 has a displacement volume which is the volumetric change within each combustion cylinder 24 as it moves from a bottom dead center to a top dead center position, or vice versa. The displacement volume may be selected dependent upon the specific application of internal combustion engine 10. The sum of the displacement volumes for each of combustion cylinders 24 defines a total displacement volume for internal combustion engine 10.

Exhaust manifold 14 receives combustion products from combustion cylinders 24 and has an outlet 28 through which the combustion products are discharged.

Turbocharger 16 includes a turbine 30 and a compressor 32. Turbine 30 is driven by the exhaust gases which flow from outlet 28 of exhaust manifold 14. Turbine 30 is coupled with compressor 32 via linkage 34 and rotatably drives compressor 32. Compressor 32 receives combustion air from the ambient environment (as indicated by line 36) and provides compressed combustion air via fluid conduit 38.

ATAAC 18 receives the compressed combustion air from compressor 32 via fluid conduit 38 and cools the combustion air. In general, ATAAC 18 is a heat exchanger including one or more fluid passageways through which the compressed combustion air flows. Cooling air flows around the fluid passageways to cool the combustion air transported through the passageways. The cooled combustion air is transported from ATAAC 18 through outlet 40.

Mixing vessel 20 receives the cooled and compressed combustion air from ATAAC 18 at inlet 42. In addition, mixing vessel 20 also receives exhaust gas from exhaust manifold 14 via fluid conduit 44 at a second inlet 46 which may or may not be cooled by an optional EGR gas cooler 47. More particularly, a controllable valve 48 which is connected with exhaust manifold 14 controls a flow of exhaust gas through fluid conduit 44. The exhaust gas flows through fluid conduit 44 and enters into mixing vessel 20 in a parallel flow arrangement with respect to the cooled and compressed combustion air entering through first inlet 42. The combustion air and exhaust gas mix within mixing vessel 20 and the mixture is transported through an outlet 50 to intake manifold 22. Intake manifold 22 provides the mixture of charged combustion air and exhaust gas to the individual combustion cylinders 24 within cylinder head 12.

Figure 2:
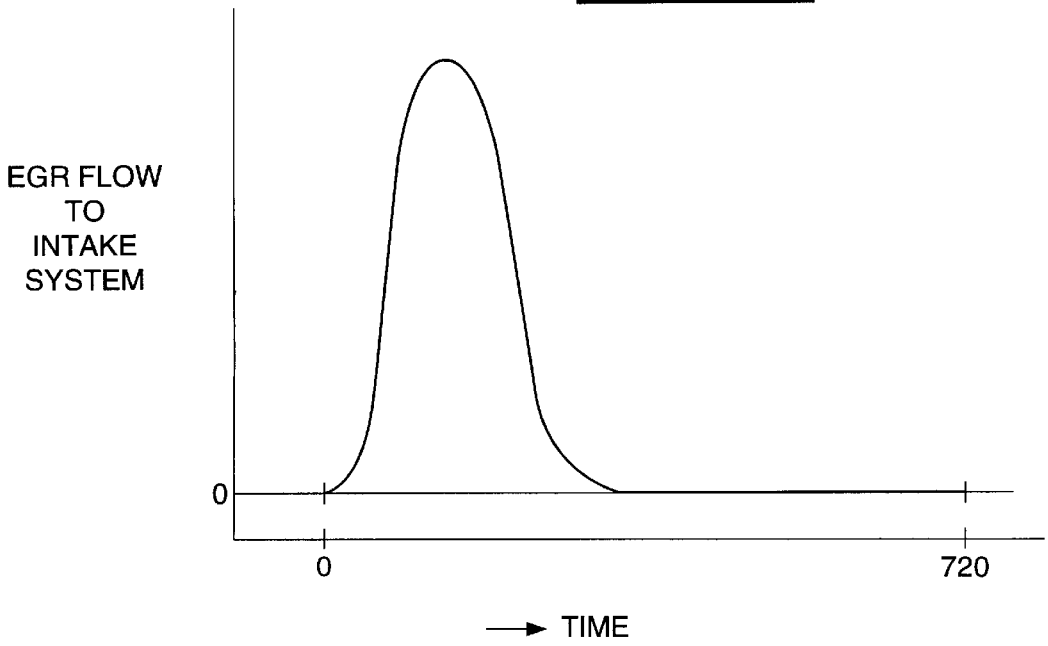
FIG. 2 is a graphical illustration of the exhaust gas flow to the mixing vessel using exhaust gas from a single cylinder as shown in FIG. 1.

FIG. 2 illustrates exhaust gas flow from exhaust manifold 14 to mixing vessel 20. More particularly, controllable valve 48 is associated with exhaust gas from only one of cylinders 24 within cylinder head 12. Accordingly, the flow of exhaust gas to mixing vessel 20 is of a pulsed nature as shown by FIG. 2. Assuming that internal combustion engine 10 is a four stroke engine, a complete cycle occurs during two revolutions of the crank shaft (i.e., 720°). The exhaust valves are opened during part of one revolution (360°) of the crank shaft, during which the exhaust gases are transported from exhaust manifold 14 to mixing vessel 20. The exhaust valves are closed during the remaining 360° of the four stroke cycle and thus no additional exhaust gas is transported to mixing vessel 20.

Figure 3:
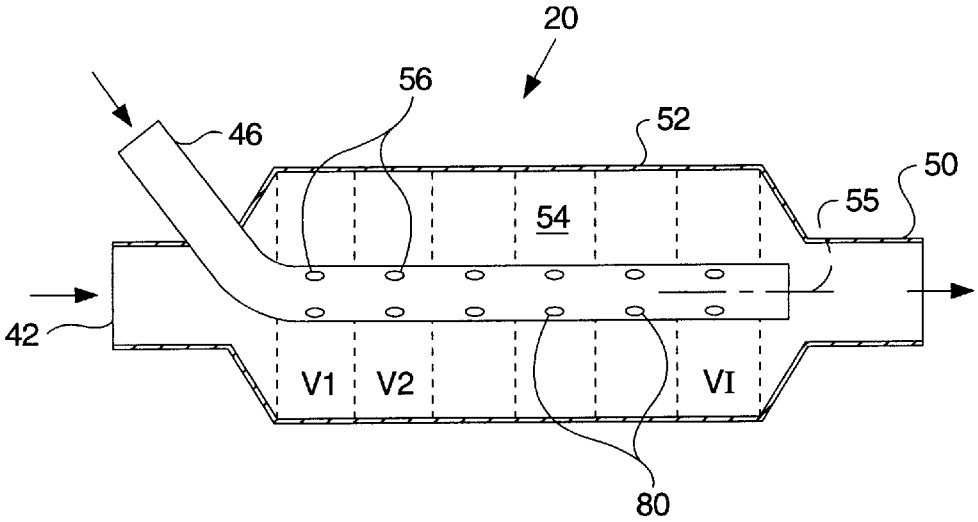
FIG. 3 is a side, sectional view of the mixing vessel shown in FIG. 1.

Referring to FIG. 3, mixing vessel 20 is shown in more detail. Mixing vessel 20 includes a generally cylindrical body 52 defining a mixing chamber 54 therein. It is understood, however, that body 52 can have any desired shape. Second inlet 46 is in the form of a pipe which extends into mixing chamber 54 and extends along the length of body 52 generally concentrically with longitudinal axis 55 of body 52. That is, the longitudinal axis of pipe 46 (not numbered) is generally concentric with longitudinal axis 55 of body 52.

Mixing chamber 54 has a total volume which is dependent upon the total displacement volume of combustion cylinders 24. That is, mixing chamber 54 is conceptually but not physically divided into a plurality of volumes V1 through VI, where I is the number of combustion cylinders 24 within cylinder head 12 (conceptually illustrated by dashed lines separating volumes V1, V2 . . . VI in FIG. 3). In the embodiment shown, mixing chamber 54 is divided into six volumes, and thus internal combustion engine 10 is assumed to include six combustion cylinders 24. Each volume V1 . . . VI is approximately the same as the displacement volume of a corresponding combustion cylinder 24. Thus, the total volume within mixing chamber 54 is approximately the same as the total displacement volume of combustion cylinders 24 within internal combustion engine 10. By providing mixing chamber 54 with a volume which corresponds to the total displacement volume of combustion cylinders 24, the mixture of combustion air and exhaust gas within mixing chamber 54 is correspondingly sized to provide the mixture to each of combustion cylinders 24, rather than providing a mixture to some combustion cylinders while providing only combustion air to others.

To further ensure that adequate mixing of the combustion air with the exhaust gas occurs within combustion chamber 54, fluid conduit 46 includes a plurality of radially extending holes 56 which open into mixing chamber 54. Each volume V1 . . . VI is associated with a plurality of holes 56, with the number and/or size of holes 56 varying from one volume to another. By properly configuring the number and/or size of holes associated with each volume V1 . . . VI, a substantially constant and uniform flow of exhaust gas is injected into each volume V1 . . . VI. Thus, not only is the configuration of mixing vessel 20 sufficient to reduce or eliminate pulsation of the exhaust gas into intake manifold 22, but also the mixture is uniformly provided to each of the combustion cylinders during operation of internal combustion engine 10.

Figure 5:
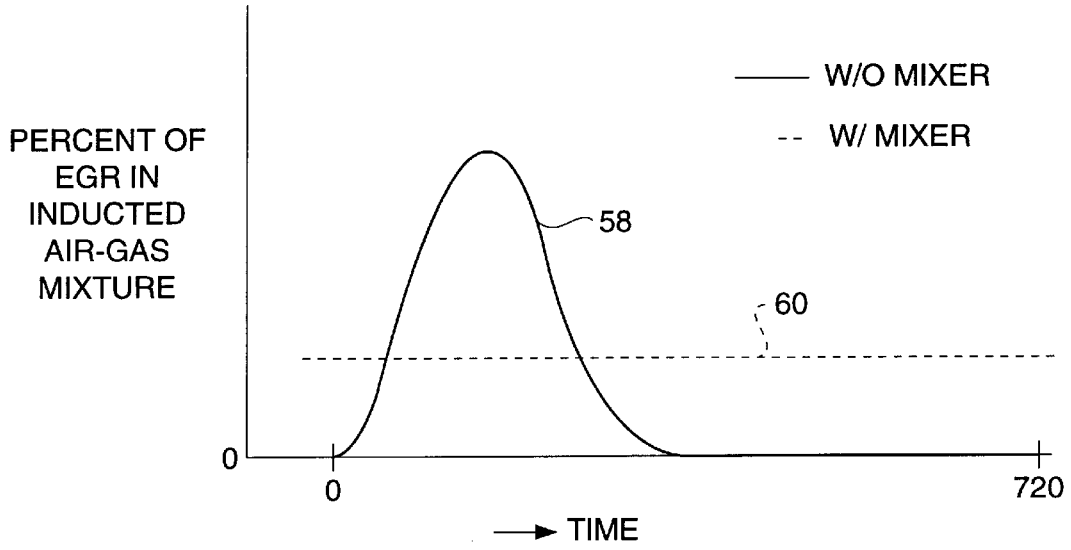
FIG. 5 is a graphical illustration of the percentage of exhaust gas in the combustion air mixture using both a conventional inductor as well as the mixing vessel of FIGS. 1 and 3.

FIG. 5 is a graphical illustration of the flow of exhaust gas into the air-gas mixture in an internal combustion engine with a conventional inductor (line 58) and with mixing vessel 20 of the present invention (line 60). A conventional EGR system which induces a flow of exhaust gas into the combustion air through a venturi section or the like receives the exhaust gas in a very pulsed manner as indicated by line 58. On the other hand, with the present invention a pulsed exhaust flow is injected into mixing chamber 54 and throughly mixed with the combustion air within volumes V1 . . . VI. Thus, the mixture of combustion air in exhaust gas which exits through outlet 50 is substantially constant as indicated by line 60.

Figure 4:
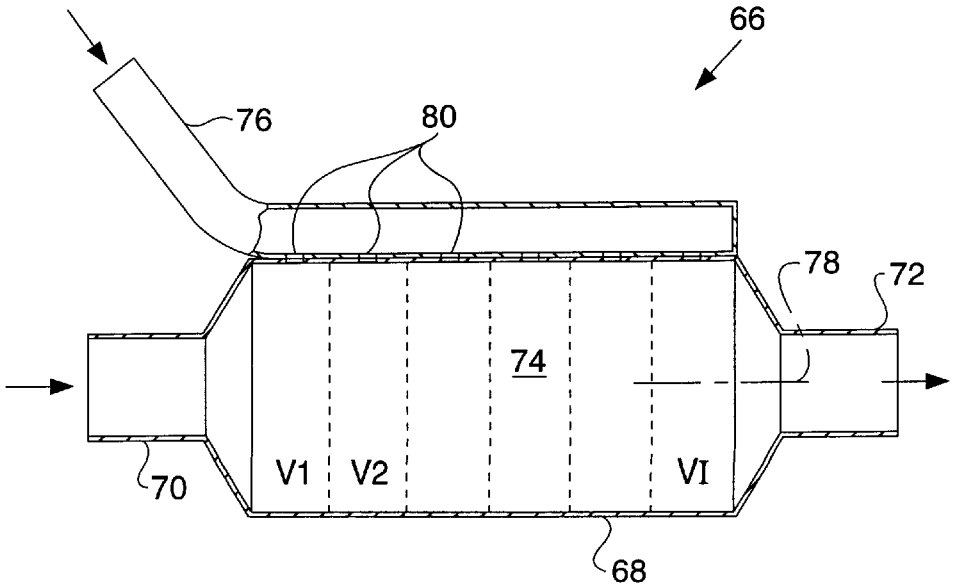
FIG. 4 is a side, sectional view of another embodiment of a mixing vessel of the present invention.

FIG. 4 illustrates another embodiment of a mixing vessel 66 of the present invention. Mixing vessel 66 includes a body 68 with an inlet 70 and an outlet 72, similar to body 52, inlet 42 and outlet 50 in the embodiment of mixing vessel 20 shown in FIG. 3. Body 68 includes a mixing chamber 74 which is conceptually divided into a plurality of volumes V1 . . . VI similar to mixing chamber 54 shown in FIG. 3. Likewise, mixing vessel 66 includes a second inlet in the form of a pipe 76 which extends along the length of mixing chamber 74, similar to pipe 46 shown in FIG. 3. However, pipe 76 does not extend into mixing chamber 74, and is not disposed generally concentrically with the longitudinal axis 78 of body 68. Rather, pipe 76 extends along and is attached to a side of body 68 along the length of mixing chamber 74. Pipe 76 includes one or more radially extending holes 80 which are fluidly connected with and open at mixing chamber 74. The number and/or size of holes 80 which are associated with each volume V1 . . . VI vary along the length of pipe 76 such that a substantially uniform flow of exhaust gas is introduced into mixing chamber 74 along the length thereof.

Figure 6:
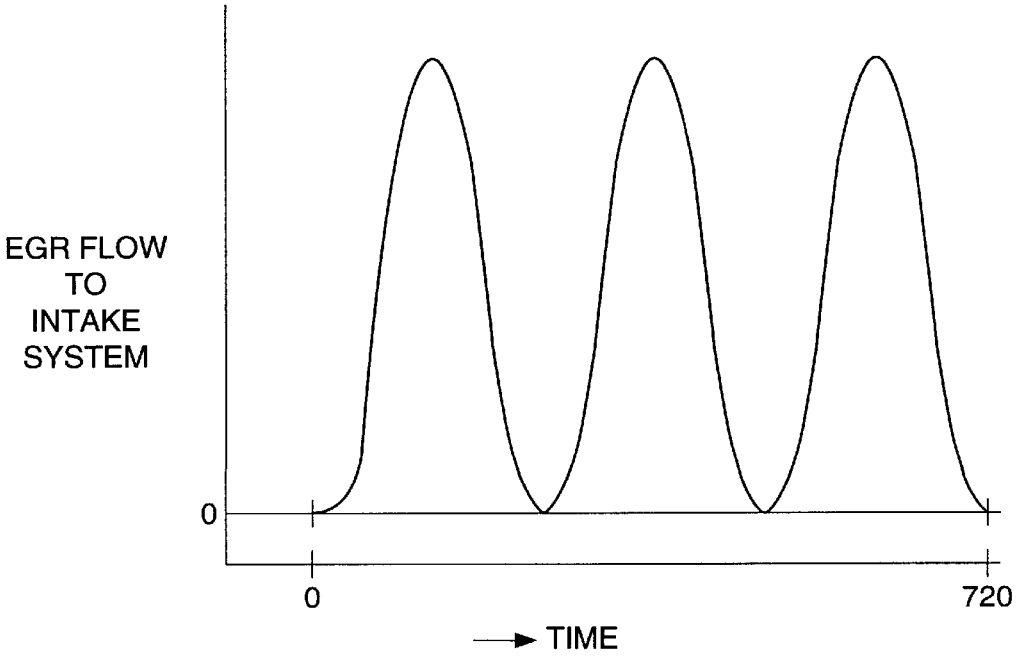
FIG. 6 is a graphical illustration of an exhaust gas system which draws exhaust gas from multiple cylinders and which may be utilized with the mixing vessels of FIGS. 1, 3 and 4.

FIG. 6 is a graphical illustration of another EGR system which may be connected with and utilize mixing vessel 20 or 66. In contrast with the graphical illustration of FIG. 2 in which the exhaust gas is used from only a single combustion cylinder, the EGR system of FIG. 6 utilizes exhaust gas from three out of six combustion cylinders within the internal combustion engine. Thus, rather than a single pulse of exhaust gas during two revolutions (four strokes), three pulses of exhaust gas are transported to mixing vessel 20 or 66 during a complete cycle of operation of the internal combustion engine. Regardless of the number of combustion cylinders from which the exhaust is pulsed during operation of the EGR system, mixing vessels 20 and 66 effectively mix the combustion air with the exhaust gas and provide a substantially non-pulsed and fully mixed combustion air and exhaust gas mixture, as indicated by line 60 in FIG. 5.

Figure 7:
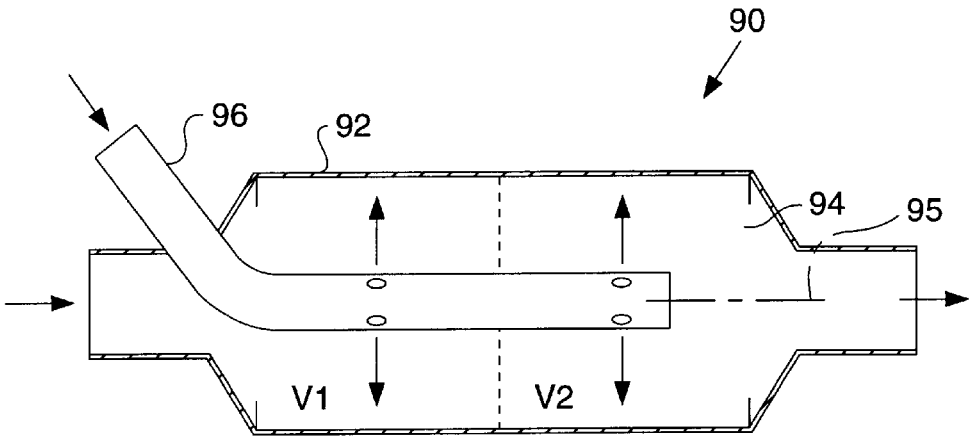
FIG. 7 is a side, sectional view of another embodiment of a mixing vessel of the present invention.

Referring now to FIG. 7, there is shown another embodiment of a mixing vessel 90 of the present invention. Mixing vessel 90 includes a body 92 defining a mixing chamber 94 therein. Second inlet 96 is in the form of a pipe which extends into mixing chamber 94 and extends along the length of body 92 generally concentrically with longitudinal axis 95 of body 92. That is, the longitudinal axis of pipe 96 (not numbered) is generally concentric with longitudinal axis 95 of body 92.

Mixing chamber 94 has a total volume which is approximately equal to the total displacement volume of two combustion cylinders 24 shown in FIG. 1. That is, mixing chamber 94 is conceptually but not physically divided into a plurality of volumes V1 and V2 which correspond to the displacement volume of two combustion cylinders 24. Mixing vessel 90 is particularly configured to be used with a combustion engine wherein approximately one-half of the combustion cylinders provide a pulse of exhaust gas to mixing vessel 90 in a sequentially time-spaced manner during operation of the internal combustion engine. For example, in the case of a six-cylinder internal combustion engine, three of the combustion cylinders may be configured to provide a pulse of exhaust gas to mixing vessel 90.

Figure 8:
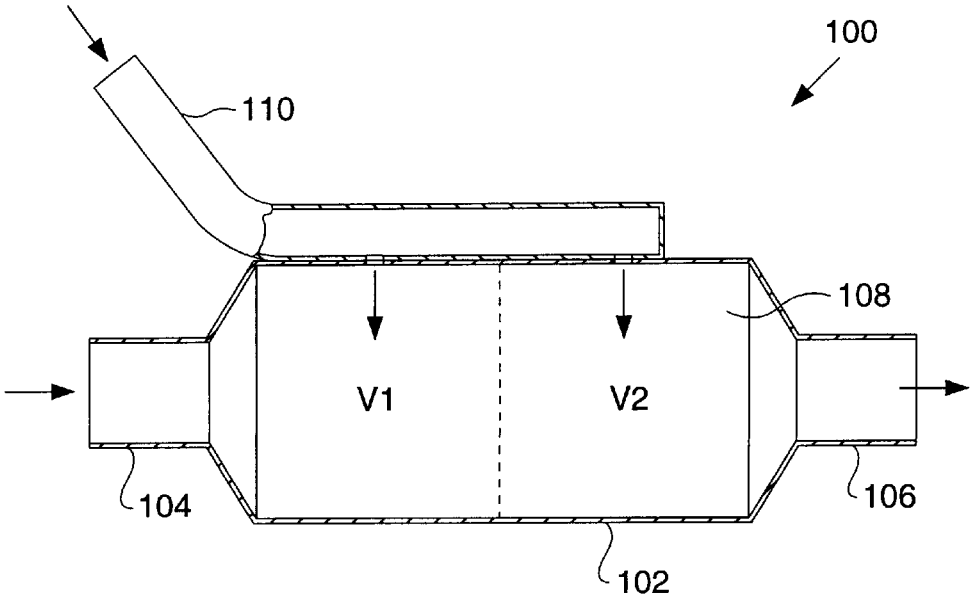
FIG. 8 is a side, sectional view of yet another embodiment of a mixing vessel of the present invention.

FIG. 8 illustrates yet another embodiment of a mixing vessel 100 of the present invention. Mixing vessel 100 includes a body 102 with an inlet 104, outlet 106 and mixing chamber 108, similar to the embodiment of mixing vessel 90 shown in FIG. 7. Moreover, mixing vessel 100 includes a second inlet in the form of a pipe 110 which is attached to a side of body 102 along a portion of the length of mixing chamber 108. Mixing chamber 108 is conceptually divided into two volumes V1 and V2, similar to the embodiment of mixing vessel 90 shown in FIG. 7, and is used in conjunction with an internal combustion engine having one-half of the combustion cylinders providing input pulses of exhaust gas to mixing vessel 100. Pipe 110 includes two injection points corresponding approximately to the center of each volume V1 and V2 for injecting exhaust gas into corresponding volumes V1 and V2.

INDUSTRIAL APPLICABILITY

During use, a plurality of pistons (not shown) reciprocate within combustion cylinders 24. Combustion occurs within combustion cylinders 24 either via compression ignition in the case of a diesel engine or via spark ignition in the case of a gasoline engine. The exhaust gases which are discharged from combustion cylinders 24 flow through exhaust manifold 14 to turbine 30 of turbocharger 16. Turbine 30 rotatably drives compressor 32 which receives combustion air and provides compressed combustion air to ATAAC 18. The cooled and compressed combustion air flows into mixing chamber 54 of mixing vessel 20. In addition, exhaust gas flows through EGR gas cooler 47 and then is controllably injected into mixing vessel 20 in a parallel relationship with respect to the combustion air. Mixing chamber 54 has a volume which corresponds to the total displacement volume of combustion cylinders 24. The exhaust gas is introduced into mixing chamber 54 along the length of mixing chamber 54. A plurality of radially extending holes 80 are spaced apart along the length of pipe 46 within mixing chamber 54, and may vary in number and/or size to provide a substantially uniform flow of exhaust gas into mixing chamber 54.

Referring to the embodiments illustrated in FIGS. 7 and 8, it is also possible to provide a mixing vessel 90 or 100 of reduced size when used in conjunction with an internal combustion engine providing exhaust gas pulses from approximately one-half of the combustion cylinders within the internal combustion engine. More particularly, the additional evenly spaced pulses from the exhaust stream allow the overall volume and therefore size of the mixer to be reduced. For the case where three pulses are provided for a six-cylinder engine, the total internal volume in the mixer between the exhaust gas introduction holes can be reduced to approximately the displacement volume of one combustion cylinder. This reduction in size greatly reduces installation and packaging problems associated with a mixing vessel, while at the same time providing a substantially non-pulsed uniform gas mixture to the intake manifold as shown in FIG. 5.

The present invention provides a mixing vessel for mixing exhaust gas with cooled and compressed combustion air for use in an internal combustion engine. The mixing vessel has a mixing chamber which is sized corresponding to the total displacement volume of the combustion cylinders within a cylinder head of the internal combustion engine. The exhaust gas is uniformly mixed within the mixing vessel. By uniformly mixing the exhaust gas and combustion air mixture and providing a mixing chamber with a volume which corresponds to the total displacement volume of the combustion cylinders, effective exhaust gas recirculation is provided. The exhaust gas may be pulled from a single combustion cylinder, while at the same time providing a mixture of the combustion air and exhaust gas to all of the combustion cylinders in a substantially non-pulsed and uniform manner.

Other aspects, objects and advantages of this invention can be obtained from a study of the drawings, the disclosure and the appended claims.

What is claimed is:

1. An internal combustion engine, comprising:

at least one cylinder head defining a plurality of combustion cylinders, each said combustion cylinder having a displacement volume;

an exhaust manifold fluidly connected to each said cylinder for transporting exhaust gas therefrom;

an intake manifold for providing combustion air to each said cylinder;

a turbocharger for providing charged combustion air to said intake manifold;

a mixing vessel having at least two inlets, at least one outlet and a mixing chamber, one of said inlets fluidly connected with said exhaust manifold and an other of said inlets fluidly connected with said turbocharger, said one inlet and said other inlet connected with said mixing vessel in a parallel manner, said mixing chamber having a volume which is approximately equal to the sum of each of said displacement volume.

2. The internal combustion engine of claim 1, wherein said one inlet comprises a fluid conduit extending into said mixing chamber.

3. The internal combustion engine of claim 2, wherein said fluid conduit includes a plurality of radially extending holes which open into said mixing chamber.

4. The internal combustion engine of claim 3, wherein said holes are differently sized.

5. The internal combustion engine of claim 4, wherein said differently sized holes are selected and arranged to provide a substantially uniform flow of exhaust gas from said fluid conduit into said mixing chamber through each of said holes along a length of said fluid conduit.

6. The internal combustion engine of claim 2, wherein said fluid conduit comprises a pipe.

7. The internal combustion engine of claim 2, wherein said mixing vessel has a first longitudinal axis, and wherein said fluid conduit has a second longitudinal axis positioned generally concentrically with said first longitudinal axis.

8. The internal combustion engine of claim 7, wherein each of said mixing vessel and said fluid conduit are generally cylindrical.

9. The internal combustion engine of claim 2, wherein said fluid conduit extends adjacent and is connected to a side of said mixing vessel.

10. A method of recirculating exhaust gas in an internal combustion engine, comprising the steps of:

providing at least one cylinder head defining a plurality of combustion cylinders, each said combustion cylinder having a displacement volume;

providing an exhaust manifold and an intake manifold, each fluidly connected to each said cylinder;

providing a mixing vessel having at least two inlets, at least one outlet and a mixing chamber, one of said inlets fluidly connected with said exhaust manifold and an other of said inlets fluidly connected with a turbocharger, said one inlet and said other inlet connected with said mixing vessel in a parallel manner;

transporting exhaust gas from said exhaust manifold to said one inlet;

transporting combustion air from said turbocharger to said other inlet;

mixing said exhaust gas and said combustion air within said mixing chamber in a volume which is approximately equal to the sum of each of said displacement volume; and transporting said mixed exhaust gas and combustion air to said intake manifold.

11. The method of claim 10, wherein said one inlet comprises a fluid conduit with a plurality of radially extending and differently sized holes which are in communication with said mixing chamber, and wherein said first transporting step comprises providing a substantially uniform flow of exhaust gas from said exhaust manifold into said mixing chamber along a length of said fluid conduit.

* * * * *